US007034465B2

(12) United States Patent
Liess et al.

(10) Patent No.: US 7,034,465 B2
(45) Date of Patent: Apr. 25, 2006

(54) DEVICE FOR OPERATING DISCHARGE LAMPS BY MEANS OF A TRANSFORMER WITH FOUR WINDINGS, AND A CORRESPONDING METHOD

(75) Inventors: Uwe Liess, München (DE); Siegfried Mayer, Moosinning (DE); Harald Schmitt, München (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 158 days.

(21) Appl. No.: 10/697,331

(22) Filed: Oct. 31, 2003

(65) Prior Publication Data

US 2004/0100211 A1 May 27, 2004

(30) Foreign Application Priority Data

Nov. 13, 2002 (DE) ..... 102 52 834

(51) Int. Cl.
*H01J 13/46* (2006.01)

(52) U.S. Cl. ..... 315/64; 315/309

(58) Field of Classification Search ..... 315/64, 315/70, 239, 244, 291, 309, 312, DIG. 5, 315/DIG. 7

See application file for complete search history.

(56) References Cited

U.S. PATENT DOCUMENTS

| | | | | | |
|---|---|---|---|---|---|
| 3,921,032 | A | * | 11/1975 | Hallay | 315/106 |
| 4,010,399 | A | * | 3/1977 | Bessone et al. | 315/101 |
| 4,392,085 | A | * | 7/1983 | Knoll et al. | 315/173 |
| 4,547,705 | A | * | 10/1985 | Hirayama et al. | 315/219 |
| 4,560,908 | A | * | 12/1985 | Stupp et al. | 315/219 |
| 5,021,714 | A | * | 6/1991 | Swanson et al. | 315/101 |
| 5,432,406 | A | * | 7/1995 | Brooks | 315/94 |
| 5,612,597 | A | * | 3/1997 | Wood | 315/293 |
| 5,932,974 | A | * | 8/1999 | Wood | 315/119 |
| 6,118,227 | A | * | 9/2000 | Beland | 315/276 |
| 6,348,769 | B1 | * | 2/2002 | Pinchuk et al. | 315/307 |
| 6,724,152 | B1 | * | 4/2004 | Nostwick | 315/207 |
| 6,731,075 | B1 | * | 5/2004 | Pak | 315/274 |
| 6,806,657 | B1 | * | 10/2004 | Rudolph et al. | 315/276 |

* cited by examiner

*Primary Examiner*—Thuy Vinh Tran

(57) ABSTRACT

A device for operating a plurality of discharge lamps is to be fashioned cost-effectively. Consequently, two discharge lamps (71, 72) are operated with the aid of one ballast in whose load circuit the heating current for the individual incandescent filaments (711, 712, 721, 722) is transmitted via a heating transformer with three secondary windings ($L_{hs1}$, $L_{hs2}$, $L_{hs3}$). The associated primary winding ($L_{hp}$) is located in a coupling-out circuit (30) with the aid of which the required heating energy is coupled out via an inductor ($L_{res}$). The heating current can be controlled by a temperature-sensitive thermistor (PTC).

9 Claims, 3 Drawing Sheets

– Prior Art –

– Prior Art –

– Prior Art –

– Prior Art –

DEVICE FOR OPERATING DISCHARGE LAMPS BY MEANS OF A TRANSFORMER WITH FOUR WINDINGS, AND A CORRESPONDING METHOD

FIELD OF THE INVENTION

The present invention relates to a device for operating at least two discharge lamps. Moreover, the present invention relates to a corresponding method for operating two discharge lamps. In particular, the present invention relates to electronic ballasts in which such a device is integrated. Operating discharge lamps comprises in this case both their starting and their being alight.

BACKGROUND OF THE INVENTION

It is known to operate two discharge lamps with two load circuits. In this case, the term load circuit refers to the load of a bridge that is used as an inverter to operate a discharge lamp. Each load circuit has a dedicated preheating arrangement for the respective lamp. Furthermore, according to the internal prior art, it is possible to operate two lamps in one load circuit. Here, the primary coil of a heating transformer of a series circuit of two lamps is connected in parallel and the secondary coil of the heating transformer is connected between the two lamps. Furthermore, it is possible to heat all the filaments of the lamps by transformer via secondary windings, the primary winding being situated in a section of the bridge suitable for the application.

It is relatively complicated to implement the load circuits in terms of circuitry, since electronic control circuits with relay or transistor switches are required for a defined, sequential starting and subsequent joint operation of the lamps. By contrast, relatively favorable control circuits that use only passive components for controlling the preheating exist for the purpose of operating individual lamps. The essential constituent of such circuits is a heat-sensitive resistor with a positive temperature coefficient.

A bridge circuit with a relevant load circuit is illustrated in FIG. 1. The bridge is implemented for the purpose of inversion as a half bridge with two switching elements 1 and 2 and two capacitors 3 and 4. The load circuit 5 in the bridge comprises a coil 6 in series with a lamp 7 which is connected in parallel both with a resonance capacitor 8 and with a heat-sensitive resistor 9.

The mode of operation of the circuit illustrated in FIG. 1 may be explained as follows. By actuating the switches 1 and 2 suitably, an AC voltage for the load circuit 5 is generated in the center tap of the bridge from the DC voltage. The frequency of the AC voltage is advantageously in the region of the resonant frequency of the coil 6 and the capacitor 8 for the ignition process of the lamp. Before the ignition, as (PTC) thermistor the resistor 9 with a positive temperature coefficient (PTC) detunes the series resonant circuit 6, 8 in such a way that the required ignition voltage across the lamp 7 or the capacitor 8 is not reached. However, the current is already flowing through the incandescent filaments 10 and 11 of the lamp 7 such that they are preheated for the ignition process. In the meantime, current is likewise flowing through the PTC thermistor 9, which it heats in this preheating phase. Its resistance rises in the process, and so the detuning of the series resonant circuit, 6, 8 is correspondingly reduced such that the ignition voltage across the lamp 7 can be reached. The PTC thermistor 9 is designed in this case such that it carries a sufficient quantity of current even after ignition in order to remain highly resistant so that the resonance can be maintained at an appropriate level of quality.

For the sake of clarity, the load circuit 5 is illustrated in FIG. 2*a* without the coil 6. FIG. 2*b* shows a variant of the load circuit of FIG. 2*a*. Connected in series with the PTC thermistor 9 is a series capacitor 12 which has the effect that the detuning of the resonant circuit by the PTC thermistor 9 is not so marked as in the case of the circuit of FIG. 2*a*. This means that in this case the ignition voltage is reached more quickly and the lamp is ignited more rapidly as a consequence thereof.

A further variant of the load circuits that are illustrated in FIGS. 2*a* and 2*b* is reproduced in 2*c*. In this case, the series capacitor 12 is chiefly active in the cold state of the PTC thermistor 9, whereas the series circuit of the two capacitors 8 and 9 is only active in the warm state of the PTC thermistor 9, that is to say during the operation and ignition of the lamp.

SUMMARY OF THE INVENTION

The object of the present invention consists in proposing a cost-effective preheating circuit for operating two lamps.

According to the invention, this object is achieved by means of a device for operating at least one first and one second discharge lamp having a coupling-out device for coupling out a heating current for the incandescent filaments of the discharge lamps from a supply branch of the device, the coupling-out device having a current control device for controlling the heating current, and a heating transformer unit, and respectively having a first contact device connected to the supply branch, and a second contact device for making contact with the first and second discharge lamp, a secondary coil unit of the heating transformer unit being connected to the first and second contact device for the purpose of supplying the incandescent filaments with heating current.

The advantage of the inventive circuit resides in that by contrast with the preheating circuit for one lamp the additional outlay for preheating a second lamp lies essentially in one component, specifically a transformer for transmitting the heating energy to the incandescent filaments of the two lamps.

The secondary coil unit preferably comprises three coils, specifically a first secondary coil for supplying a first incandescent filament of the first discharge lamp, a second secondary coil for supplying a second incandescent filament of the first discharge lamp and a first incandescent filament of the second discharge lamp, and a third secondary coil for supplying a second incandescent filament of the second discharge lamp. It is thereby possible for the individual incandescent filaments of the discharge lamps to be preheated in a targeted fashion by means of a transformer with four windings.

In one advantageous refinement of the inventive device, the supply branch comprises a resonance inductor and a resonance capacitor. The two lamps can thereby be operated with the aid of one resonant circuit. The resonance inductor can be used as an inductor. Furthermore, the resonance inductor can be at least a part of a coupling-out transformer for supplying the coupling-out device, or have an appropriate tap therefor.

The current control device advantageously comprises a PTC thermistor with a positive temperature coefficient. This component permits a relatively simple and cost-effective control of the preheating for the lamps. Instead of the PTC thermistor, the current control device can comprise a transistor. It is possible thereby to control the preheating in a more targeted but also more complicated way.

A sequential starting capacitor can be provided in parallel with the first and/or second contact device; it can be used advantageously to control the sequential starting sequence in the case of at least two lamps. Consequently, it is possible to achieve sequential starting in order to avoid very high ignition currents/voltages being reached, said starting permitting the use of components which cannot be so highly loaded and are therefore more cost-effective.

The inventive device is advantageously integrated in an electronic ballast for fluorescent lamps. It is thereby possible to operate two or more lamps with the aid of one ballast.

BRIEF DESCRIPTION OF THE DRAWINGS

The invention will now be explained in more detail with the aid of the attached drawings, in which.

DETAILED DESCRIPTION OF THE INVENTION

The exemplary embodiments described below constitute only preferred embodiments of the present invention.

Figure 1:
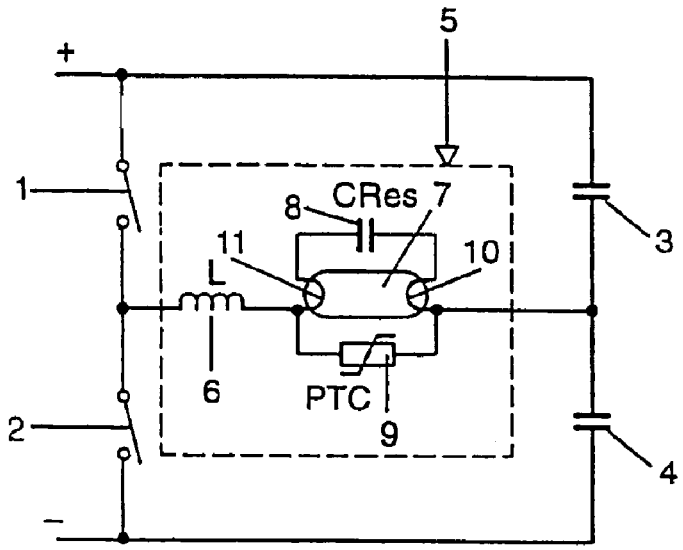
FIG. 1 shows a circuit diagram of a half bridge with a load circuit in accordance with the prior art, for operating a fluorescent lamp.
Figure 2A:
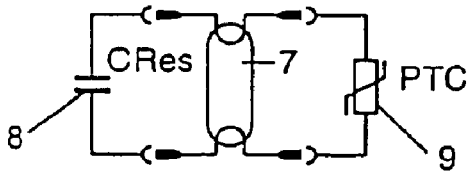
FIGS. 2*a*, 2*b*, 2*c* show variants of the load circuits in accordance with the prior art.
Figure 2B:
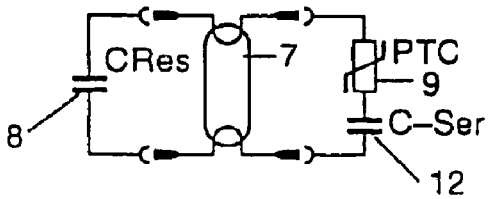
Figure 2C:
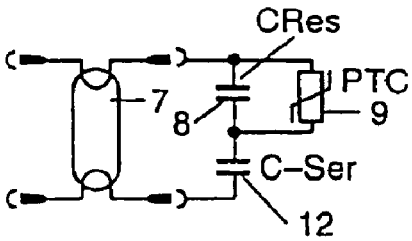
Figure 3A:
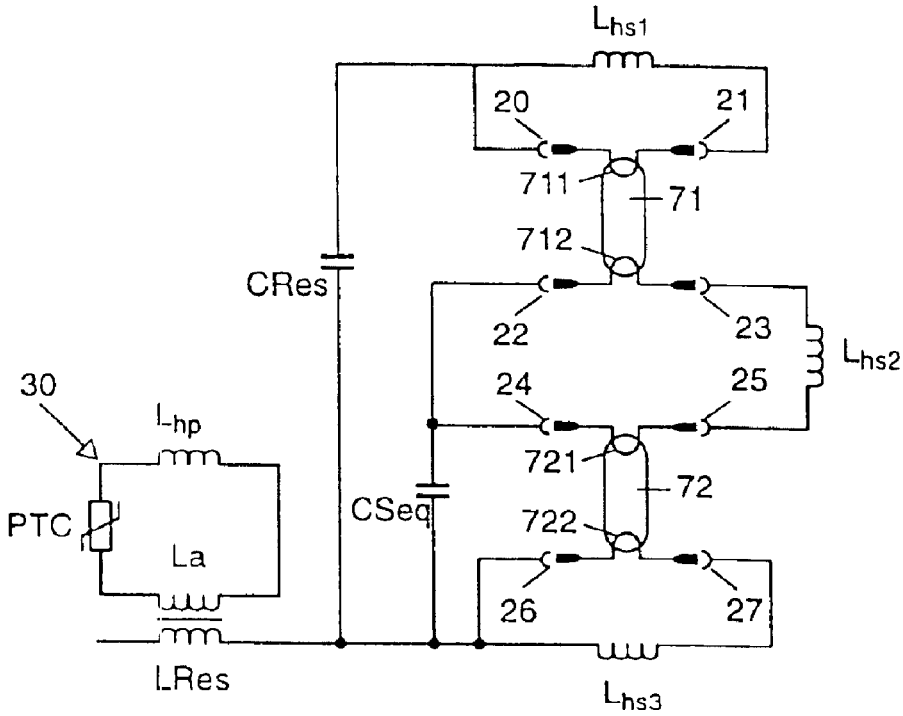
FIGS. 3*a*, 3*b*, 3*c* show variants of inventive load circuits for operating at least two lamps.

FIG. 3*a* shows an inventive load circuit in a ballast for two discharge lamps 71 and 72. The discharge lamp 71 has two incandescent filaments 711 and 712. Likewise, the second discharge lamp 72 has incandescent filaments 721 and 722. The circuit has terminals 20 and 21 for the incandescent filament 711 of the first discharge lamp 71, terminals 22 and 23 for the second incandescent filament 712 of the first discharge lamp 71, terminals 24 and 25 for the first incandescent filament 721 of the second discharge lamp 72, and terminals 26 and 27 for the second incandescent filament 722 of the second discharge lamp 72.

The supply branch for the two discharge lamps 71 and 72 comprises a resonant circuit composed of a resonance capacitor $C_{res}$ and a resonance inductor $L_{res}$. The resonance capacitor $C_{res}$ is connected between the terminals 20 and 26.

The coupling-out circuit 30 is driven via a coupling-out transformer that comprises, on the primary side, the inductor or resonance inductor $L_{res}$ and, on the secondary side, a coil $L_a$. In addition to the secondary coil $L_a$ of the coupling-out transformer, this coupling-out circuit 30 comprises a temperature-dependent thermistor PTC and a primary coil $L_{hp}$ of a heating transformer. The heating transformer has three coils on the secondary side. The first secondary-side heating coil $L_{hs1}$ is connected between the terminals 20 and 21 for the first incandescent filament 711 of the first discharge lamp 71. The second secondary coil $L_{hs2}$ is connected to the terminals 23 and 25 for the second incandescent filament 712 of the first discharge lamp and the first incandescent filament 721 of the second discharge lamp 72. The third secondary heating coil $L_{hs3}$ is connected between the terminals 26 and 27 for the second incandescent filament 722 of the second discharge lamp 72.

Moreover, the terminals 22 and 24 for the two incandescent filaments 712 and 721 are interconnected. Finally, a sequential starting capacitor $C_{seq}$ is connected between the terminals 24 and 26.

The mode of operation of the load circuit illustrated in FIG. 3*a* may be explained in more detail below. The supply branch with the resonant circuit $C_{res}$ and $L_{res}$ is very strongly damped at the beginning of operation. The reason for this is that at the start of operation the temperature-dependent thermistor PTC is still cool and therefore of low resistance. Consequently, a high energy component can be coupled out from the supply branch into the coupling-out circuit 30 via the coupling-out transformer $L_{res}$, $L_a$. The heating current flowing in the coupling-out circuit 30 is transmitted to the respective incandescent filaments via the heating transformer with the primary-side winding $L_{hp}$ and the three secondary-side windings $L_{hs1}$, $L_{hs2}$ and $L_{hs3}$. In this case, the incandescent filaments 711 and 722 are respectively supplied individually by means of the coils $L_{hs1}$, and $L_{hs3}$, and the two incandescent filaments 712 and 721 are supplied jointly by means of the coil $L_{hs2}$.

The two lamps 71 and 72 constitute a voltage divider at the resonance capacitor $C_{res}$. By virtue of the fact that the sequential starting capacitor $C_{seq}$ is connected in parallel with the second discharge lamp 72, a smaller voltage drops across the second discharge lamp 72 than across the first discharge lamp 71. Consequently, the first discharge lamp 71 ignites before the second discharge lamp 72.

At the end of the heating phase, the temperature-dependent thermistor PTC itself has been heated to such an extent that it has become of high resistance. Consequently, the damping of the resonant circuit $C_{Res}$, $L_{Res}$ decreases, and the voltage across the discharge lamps 71 and 72 rises on the basis of the rise in the quality of the resonant circuit.

After the ignition, the current flows to the terminal 26 in the burning phase substantially from the terminal 20 via the incandescent filament 711, the incandescent filament 712, the terminal 22, the terminal 24, the incandescent filament 721 and the incandescent filament 722.

Owing to the high resistance of the thermistor PTC, the current in the coupling-out circuit 30, thus also the heating current for the incandescent filaments is greatly reduced in the burning phase. Consequently, all the filaments are subjected only to minimal heating during operation of the lamp in the burning phase.

Figure 3B:
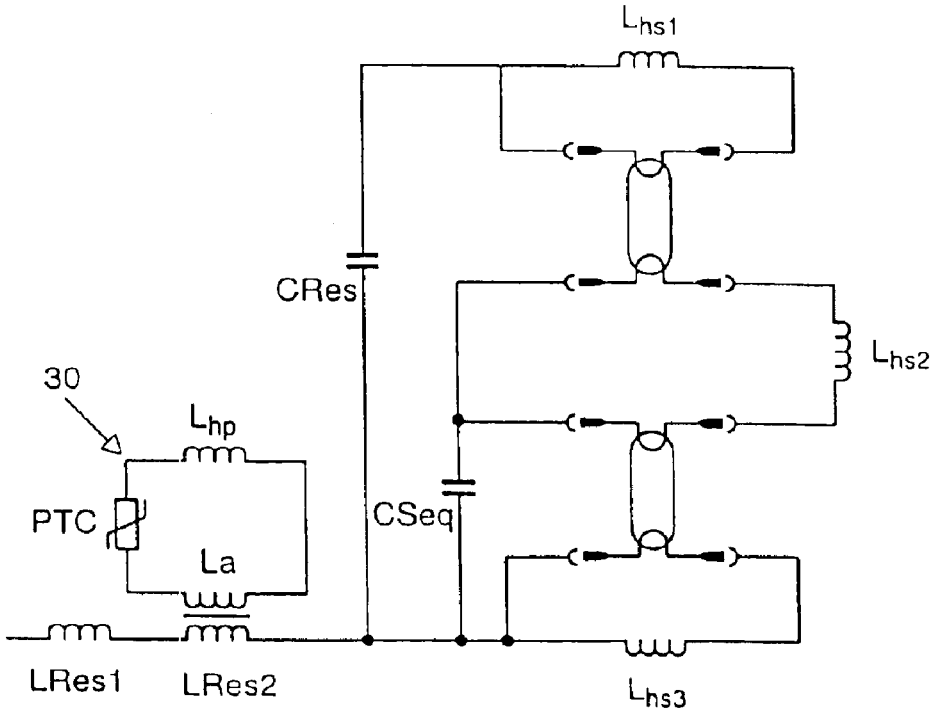

A second embodiment of the present invention is illustrated in FIG. 3*b*. It differs from the first embodiment in accordance with FIG. 3*a* only in that the resonance inductor is bipartite. It comprises the portions $L_{res1}$ and $L_{res2}$, the second part $L_{res2}$ constituting the primary coil of the coupling-out transformer. Owing to the bipartite nature of the resonance inductor, it is possible to use a standard transformer for coupling out, and to adapt the primary coil $L_{res2}$ thereof to the resonance requirements of the supply branch by means of a separate inductor $L_{res1}$.

Figure 3C:
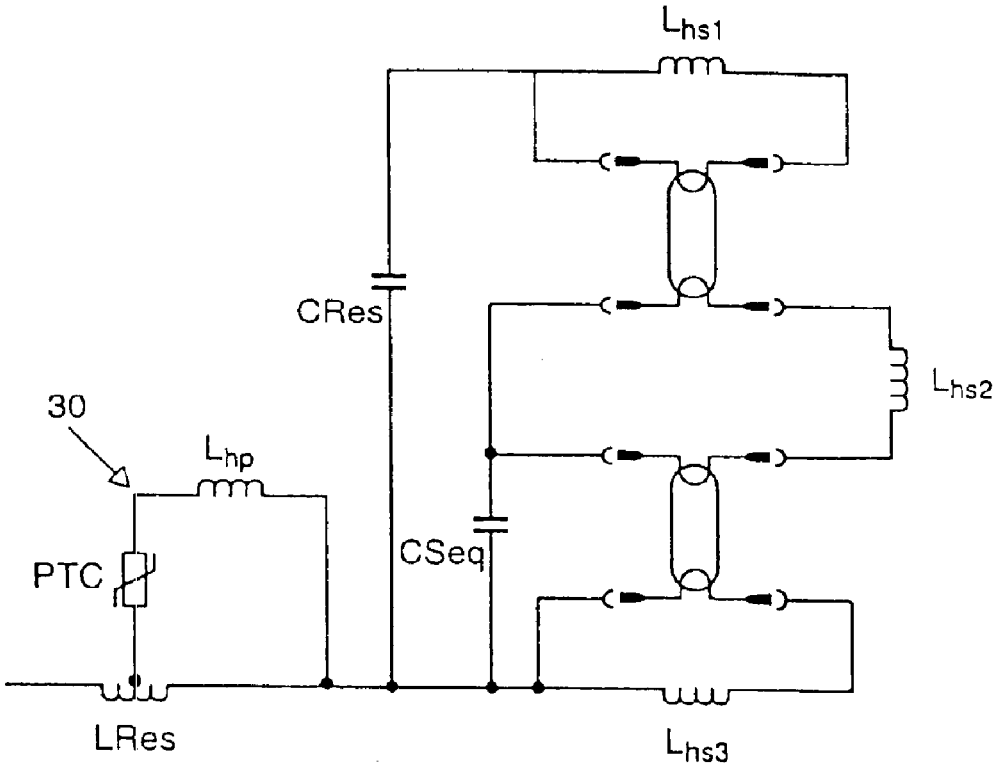

A further embodiment of the present invention is illustrated in FIG. 3*c*. Once again, the circuit design is virtually identical to that of FIG. 3*a*. Instead of a coupling-out transformer, however, use is made here of a tap at the resonance inductor $L_{res}$. This means that the coupling-out circuit 30 is directly coupled to the resonance inductor $L_{res}$. The resonant circuit 30 therefore comprises the tapped part of the resonance inductor $L_{res}$ in series with the PTC thermistor and the primary coil $L_{hp}$ of the heating transformer.

The modes of operation of the embodiments illustrated in FIGS. 3*b* and 3*c* are essentially identical to that of FIG. 3*a*. The coupling-out circuit is driven by direct or inductive coupling to provide the heating current.

What is claimed is:

1. A device for operating a first discharge lamp (71) and a second discharge lamp (72), the device comprising:

first and second terminals (20,21) for coupling to a first filament (711) of the first lamp (71);

third and fourth terminals (22,23) for coupling to a second filament (712) of the first lamp (71);

fifth and sixth terminals (24,25) for coupling to a first filament (721) of the second lamp (72);

seventh and eighth terminals (26,27) for coupling to a second filament (722) of the second lamp (72);

a resonance inductor (LRes) coupled to the seventh terminal (26);

a resonance capacitor (CRes) coupled between the first terminal (20) and the seventh terminal (26);

a current control device (PTC);

a secondary coil (La) magnetically coupled to the resonance inductor (LRes) and electrically coupled series with the current control device (PTC); and a heating transformer comprising a primary coil ($L_{hp}$), a first secondary coil ($L_{hs1}$), a second secondary coil ($L_{hs2}$), and a third secondary coil ($L_{hs3}$), wherein:

the primary coil ($L_{hp}$) is coupled in series with the current control device (PTC) and the secondary coil (La);

the first secondary coil ($L_{hs1}$) is coupled between the first and second terminals (20,21);

the second secondary coil ($L_{hs2}$) is coupled between the fourth and sixth terminals (23,25); and the third secondary coil ($L_{hs3}$) is coupled between the seventh and eighth terminals (26,27).

2. The device of claim 1, wherein the current control device (PTC) is a FTC thermistor.

3. The device of claim 1, further comprising a sequential starting capacitor ($C_{seq}$) coupled between the fifth and seventh terminals (24,26).

4. A device for operating a first discharge lamp (71) and a second discharge lamp (72), the device comprising:

first and second terminals (20,21) for coupling to a first filament (711) of the first lamp (71);

third and fourth terminals (22,23) for coupling to a second filament (712) of the first lamp (71);

fifth and sixth terminals (24,25) for coupling to a first filament (721) of the second lamp (72);

seventh and eighth terminals (26,27) for coupling to a second filament (722) of the second lamp (72);

a first resonance inductor (LRes1);

a second resonance inductor (LRes2) coupled between the first resonance inductor (LRes1) and the seventh terminal (26);

a resonance capacitor (CRes) coupled between the first and seventh terminals (20,26);

a current control device (PTC);

a secondary coil (La) magnetically coupled to the second resonance inductor (LRes2) and electrically coupled in series with the current control device (PTC); and a heating transformer comprising a primary coil ($L_{hp}$), a first secondary coil ($L_{hs1}$), a second secondary coil ($L_{hs2}$), and a third secondary coil ($L_{hs3}$), wherein:

the primary coil ($L_{hp}$) is coupled in series with the current control device (PTC) and the secondary coil (La);

the first secondary coil ($L_{hs1}$) is coupled between the first and second terminals (20,21);

the second secondary coil ($L_{hs2}$) is coupled between the fourth and sixth terminals (23,25); and the third secondary coil ($L_{hs3}$) is coupled between the seventh and eighth terminals (26,27).

5. The device of claim 4, wherein the current control device (PTC) is a PTC thermistor.

6. The device of claim 4, further comprising a sequential starting capacitor ($C_{seq}$) coupled between the fifth and seventh terminals (24,26).

7. A device for operating a first discharge lamp (71) and a second discharge lamp (72), the device comprising:

first and second terminals (20,21) for coupling to a first filament (711) of the first lamp (71);

third and fourth terminals (22,23) for coupling to a second filament (712) of the first lamp (71);

fifth and sixth terminals (24,25) for coupling to a first filament (721) of the second lamp (72);

seventh and eighth terminals (26,27) for coupling to a second filament (722) of the second lamp (72);

a resonance inductor (LRes) coupled to the seventh terminal (26);

a resonance capacitor (CRes) coupled between the first terminal (20) and the seventh terminal (26);

a current control device (PTC) coupled to a tap on the resonance inductor (LRes); and a heating transformer comprising a primary coil ($L_{hp}$) a first secondary coil ($L_{hs1}$), a second secondary coil ($L_{hs2}$), and a third secondary coil ($L_{hs3}$), wherein:

the primary coil ($L_{hp}$) is coupled between the current control device (PTC) and the seventh terminal (26);

the first secondary coil ($L_{hs1}$) is coupled between the first and second terminals (20,21);

the second secondary coil ($L_{hs2}$) is coupled between the fourth and sixth terminals (23,25); and the third secondary coil ($L_{hs3}$) is coupled between the seventh and eighth terminals (26,27).

8. The device of claim 7, wherein the current control device (PTC) is a PTC thermistor.

9. The device of claim 7, further comprising a sequential starting capacitor ($C_{seq}$) coupled between the fifth and seventh terminals (24,26).

* * * * *